US009478898B2

(12) United States Patent
Iihoshi

(10) Patent No.: US 9,478,898 B2
(45) Date of Patent: Oct. 25, 2016

(54) WATERPROOF CONNECTOR

(71) Applicant: Sumitomo Wiring Systems, Ltd., Yokkaichi, Mie (JP)

(72) Inventor: Shinji Iihoshi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/651,022

(22) PCT Filed: Dec. 25, 2013

(86) PCT No.: PCT/JP2013/084729

§ 371 (c)(1),
(2) Date: Aug. 5, 2015

(87) PCT Pub. No.: WO2014/104122

PCT Pub. Date: Jul. 3, 2014

(65) Prior Publication Data

US 2016/0036156 A1 Feb. 4, 2016

(30) Foreign Application Priority Data

Dec. 27, 2012 (JP) ..... 2012-284662

(51) Int. Cl.
*H01R 13/40* (2006.01)
*H01R 13/52* (2006.01)

(52) U.S. Cl.
CPC ..... *H01R 13/5202* (2013.01); *H01R 13/5219* (2013.01)

(58) Field of Classification Search
CPC ..... H01R 13/5202; H01R 13/5219; H01R 13/4365; H01R 13/5213; H01R 13/4223
USPC ..... 439/587
See application file for complete search history.

(56) References Cited

U.S. PATENT DOCUMENTS

| | | | | |
|---|---|---|---|---|
| 7,066,773 | B1 * | 6/2006 | Martin | H01R 13/4365 439/752 |
| 7,168,981 | B2 * | 1/2007 | Takahashi | H01R 13/4223 439/595 |
| 7,438,585 | B2 * | 10/2008 | Morello | H01R 13/113 439/352 |
| 8,182,286 | B2 * | 5/2012 | Tamagawa | H01R 13/5213 439/587 |
| 8,651,901 | B2 * | 2/2014 | Beck, Jr. | H01R 13/4365 439/595 |
| 2005/0186842 | A1 | 8/2005 | Fukatsu et al. | |

FOREIGN PATENT DOCUMENTS

| | | |
|---|---|---|
| JP | 2006-024435 | 1/2006 |
| JP | 4193711 | 10/2008 |
| JP | 2012-043649 | 3/2012 |

OTHER PUBLICATIONS

International Search Report of Apr. 1, 2014.

* cited by examiner

*Primary Examiner* — Jean F Duverne
(74) *Attorney, Agent, or Firm* — Gerald E. Hespos; Michael J. Porco; Matthew T. Hespos

(57) ABSTRACT

A seal ring (80) is fit on an outer surface of a housing main body (11) and rests on a resting portion. When a receptacle (62) is fit externally on the housing main body (11), outer peripheral lips (84) of the seal ring (80) closely contact an inner surface of the receptacle (62). The seal ring (80) includes front and rear rings (86, 87) extending in a front-back direction at opposite front and rear sides of the outer peripheral lips (84). The rear ring (87) is longer in the front-back direction than the front ring (86). A first housing (10) includes a protrusion (23) for radially sandwiching the rear ring (87) between the protrusion (23) and the housing main body (11). When the receptacle (62) is fit externally on the housing main body (11), the protrusion (23) is covered with an opening portion (66) of the receptacle (62).

15 Claims, 10 Drawing Sheets

WATERPROOF CONNECTOR

BACKGROUND

1. Field of the Invention

The present invention relates to a waterproof connector.

2. Description of the Related Art

A waterproof connector disclosed in Publication of Japanese Patent No. 4193711 includes a pair of male and female housings connectable to each other. Out of these housings, the female housing includes an inner tube portion and an outer tube portion surrounding the inner tube portion. An annular seal member is fitted on the outer surface of the inner tube portion. On the other hand, the male housing includes a tubular receptacle externally fittable on the inner tube portion from front. Further, a plurality of lips are circumferentially provided one after another in a front-back direction on the seal member, and each lip is resiliently held in close contact with the inner surface of the receptacle to seal between the two housings when the two housings are connected.

A long and narrow rear end part of the seal member may extend backward from the rearmost lip for some reason such as a metal molding reason. On the other hand, in the process of connecting the two housings, an opening edge part of the receptacle slides in contact with each lip, whereby a shear force is applied to the seal member in a moving direction of the receptacle. Thus, if the rear end part of the seal member extends long as described above, it may be flipped or buckled along a vertical wall located behind the seal member, wherefore it may not be possible to obtain predetermined sealability.

The present invention was completed based on the above situation and aims to prevent a reduction in sealability between housings.

SUMMARY OF THE INVENTION

The present invention is directed to a waterproof connector, including a second housing including a tubular receptacle, a first housing including a housing main body on which the receptacle is to be externally fitted from front and a radially extending resting portion formed on an outer surface of the housing main body, and a seal ring fitted on the outer surface of the housing main body, having a rear end rested on the resting portion and including a lip circumferentially provided at an intermediate position in a front-back direction and to be resiliently held in contact with an inner surface of the receptacle when the receptacle is externally fitted on the housing main body, wherein the seal ring includes a front ring portion and a rear ring portion extending substantially in the front-back direction at opposite front and rear sides of the lip, the rear ring portion is radially sandwiched between the first housing and the housing main body and the first housing includes a protrusion to be covered with an opening edge portion of the receptacle when the receptacle is externally fitted on the housing main body.

When the receptacle is externally fitted on the housing main body, the seal ring is dragged in a moving direction of the receptacle and the rear ring portion may be flipped or buckled along the resting portion.

However, according to the present invention, a situation where the rear ring portion is flipped or buckled as the receptacle moves is avoided since the rear ring portion of the seal ring is radially sandwiched between the protrusion of the first housing and the housing main body. In addition, since the protrusion is covered with the opening edge portion of the receptacle when the receptacle is externally fitted on the housing main body, the rear ring portion is not directly wetted and the deformation of the rear ring portion by high-pressure water is prevented, for example, during high-pressure washing.

Thus, according to the present invention, a reduction in sealability between the housings can be prevented.

The rear ring portion is set longer in the front-back direction than the front ring portion. According to such a configuration, a merit of applying the present invention is large since there is a higher possibility that the rear ring portion is flipped or buckled.

An inner surface of the protrusion serves as a restricting surface arranged at a position facing the outer surface of the housing main body and capable of preventing the rear ring portion from being flipped up by coming into contact with the rear ring portion from an outer side. The rear ring portion is reliably prevented from being flipped up by the contact thereof with the restricting surface of the protrusion.

The first housing includes an outer side wall surrounding the housing main body and a radially extending coupling portion coupling the outer side wall and the housing main body, a fitting space into which the receptacle is to be fitted is open between the housing main body and the outer side wall and before the coupling portion, and the protrusion projects on a front surface of the coupling portion. Since the protrusion projects on the coupling portion, the protrusion does not have a specific structure and the overall configuration is simplified.

A first inclined surface inclined in a direction to approach the housing main body toward a front side is provided on an outer surface of the protrusion, and a second inclined surface arranged to face the first inclined surface when the receptacle is externally fitted on the housing main body is provided on an inner surface of the opening edge portion of the receptacle. Since the first inclined surface of the protrusion and the second inclined surface of the receptacle face each other when the protrusion is covered with the opening edge portion of the receptacle, high-pressure water during high-pressure washing is unlikely to reach the rear ring portion through a clearance between the first and second inclined surfaces and the wetting of the rear ring portion is more reliably prevented. Further, the enlargement of the connector in a direction in which the receptacle covers the protrusion is avoided.

A retaining portion for preventing forward detachment of the seal ring by being locked to the first housing is formed to radially project on the seal ring, the protrusion is not formed at a position facing the retaining portion when the seal ring is fitted on the outer surface of the housing main body, an outer side wall of the first housing is arranged at an outer side of the retaining portion, and the retaining portion is radially sandwiched between the outer side wall and the housing main body. Since the protrusion is not formed at the position facing the retaining portion, but the retaining portion is sandwiched between the outer side wall and the housing main body, the flipping and buckling of the retaining portion are also avoided similarly to the rear ring portion.

The protrusion surrounds the housing main body except at a part for locking the retaining portion. This more reliably avoids a situation where the rear ring portion is flipped or buckled and more reliably prevents the deformation of the rear ring portion by high-pressure water.

A retaining portion for preventing forward detachment of the seal ring by being locked to the first housing is formed to radially project on the seal ring, the retaining portion has a locking surface facing a lock receiving surface of the first housing in the front-back direction, the locking surface is arranged at the same position as a rear surface of the rear ring portion in the front-back direction, and a parting line of a mold is formed by the rear surface of the rear ring portion and the lock receiving surface. The rear ring portion tends to be long by specifying the parting line of the mold by the rear surface of the rear ring portion and the lock receiving surface in this way. Thus, a significance of avoiding the flipping and the like of the rear ring portion by the protrusion is large.

DETAILED DESCRIPTION OF THE PREFERRED EMBODIMENTS 1 to 10. A connector of the embodiment includes first and second housings 10, 60 connectable to each other and a seal ring 80 mounted in the first housing 10 to seal between the first and second housings 10, 60. Note that, in the following description, connecting surface sides of the first and second housings 10, 60 are referred to as front sides concerning a front-back direction.

Figure 2:
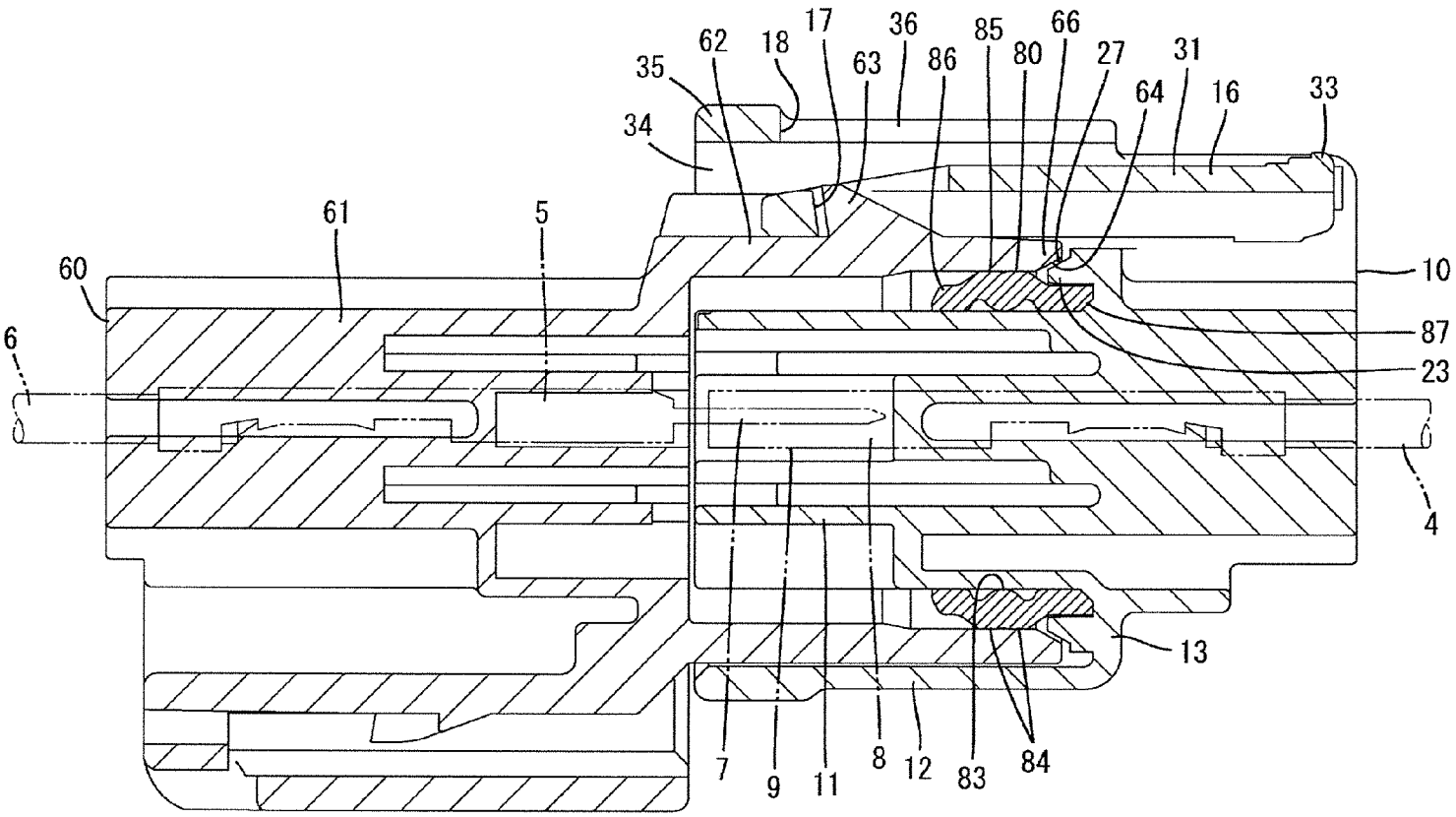
FIG. 2 is a section showing a state where the first and second housings are properly connected.

The second housing 60 is made of synthetic resin and includes, as shown in FIG. 2, a block-like terminal mounting portion 61 and a tubular receptacle 62 projecting forward from the front end of the terminal mounting portion 61. A male terminal fitting 5 is inserted and mounted into the terminal mounting portion 61 from behind. The male terminal fitting 5 is crimped and connected to an end part of a wire 6 and includes a male tab 7 projecting into the receptacle 62 in a state accommodated in the terminal mounting portion 61.

A lock portion 63 projects on the upper surface of the upper wall of the receptacle 62. Further, a tapering second inclined surface 64 is formed on the inner surface of the front end (opening end) of the receptacle 62 over the entire circumference.

Figure 8:
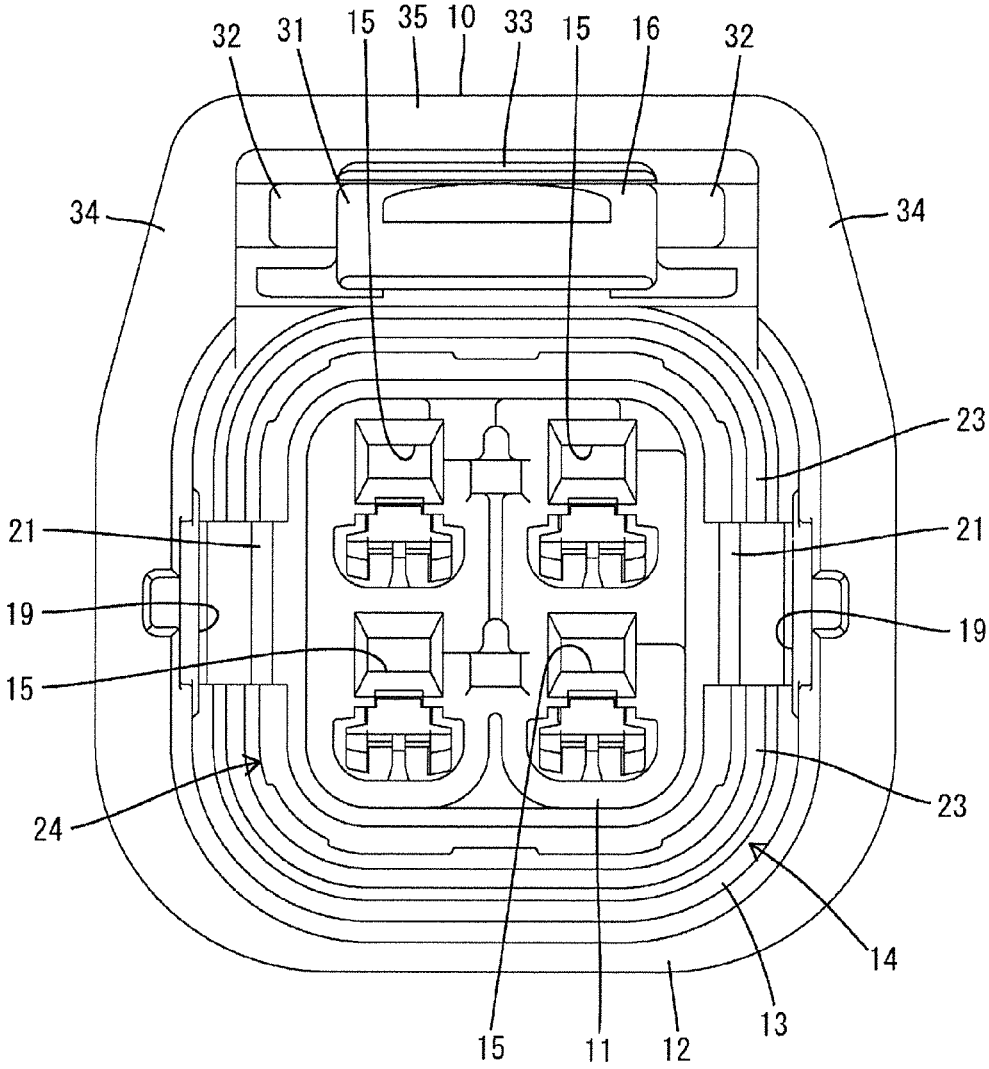
FIG. 8 is a front view of the first housing.
Figure 9:
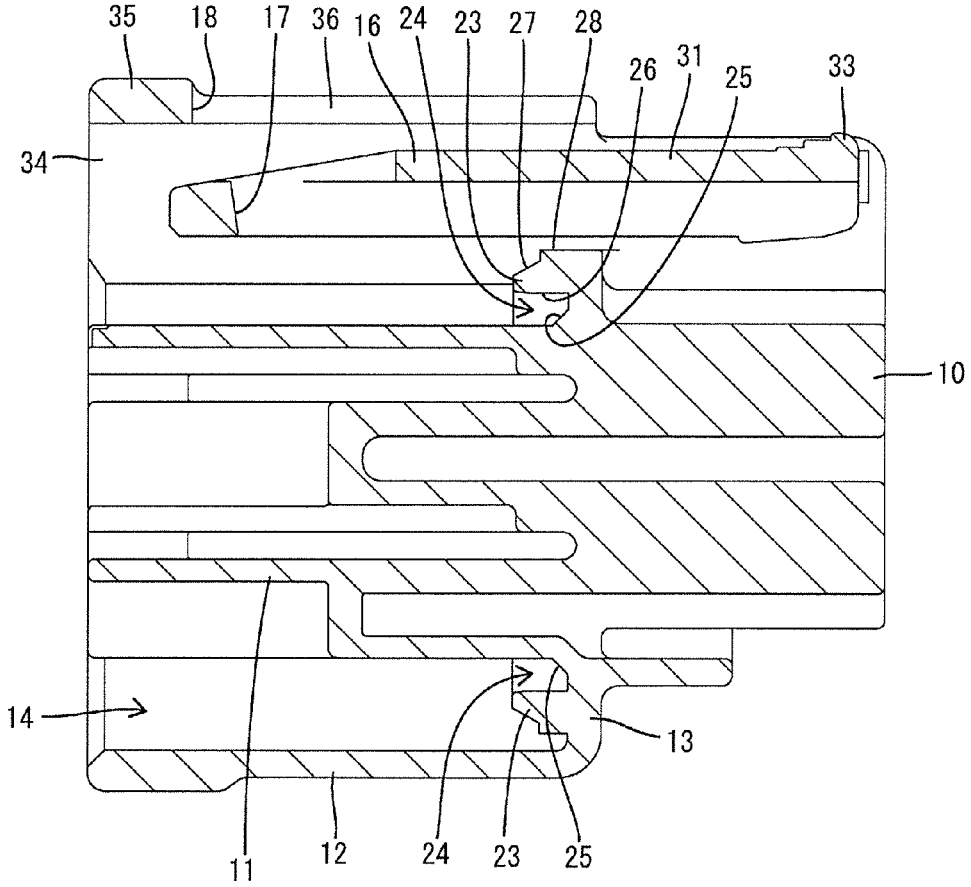
FIG. 9 is a section of the first housing.

The first housing 10 is made of synthetic resin and includes, as shown in FIGS. 8 and 9, a block-like housing main body 11, a tubular outer side wall 12 surrounding the housing main body 11 and a radially extending coupling portion 13 coupling the outer side wall 12 and the housing main body 11. A fitting space 14 into which the receptacle 62 is to be fitted is open between the housing main body 11 and the outer side wall 12 and before the coupling portion 13. That is, the receptacle 62 is externally fitted on the housing main body 11. As described later, the coupling portion 13 serves as a resting portion with which the seal ring 80 fitted on the outer surface of the housing main body 11 rests in contact.

As shown in FIG. 8, a plurality of cavities 15 are formed in the housing main body 11. A female terminal fitting 8 is inserted into each cavity 15 from behind. As shown in FIG. 2, the female terminal fitting 8 is crimped and connected to an end part of a wire 4 and includes a box portion 9, into which the male tab 7 is inserted for connection as the first and second housings 10, 60 are connected, on a front part.

As shown in FIG. 9, a lock arm 16 is provided above the housing main body 11.

Figure 6:
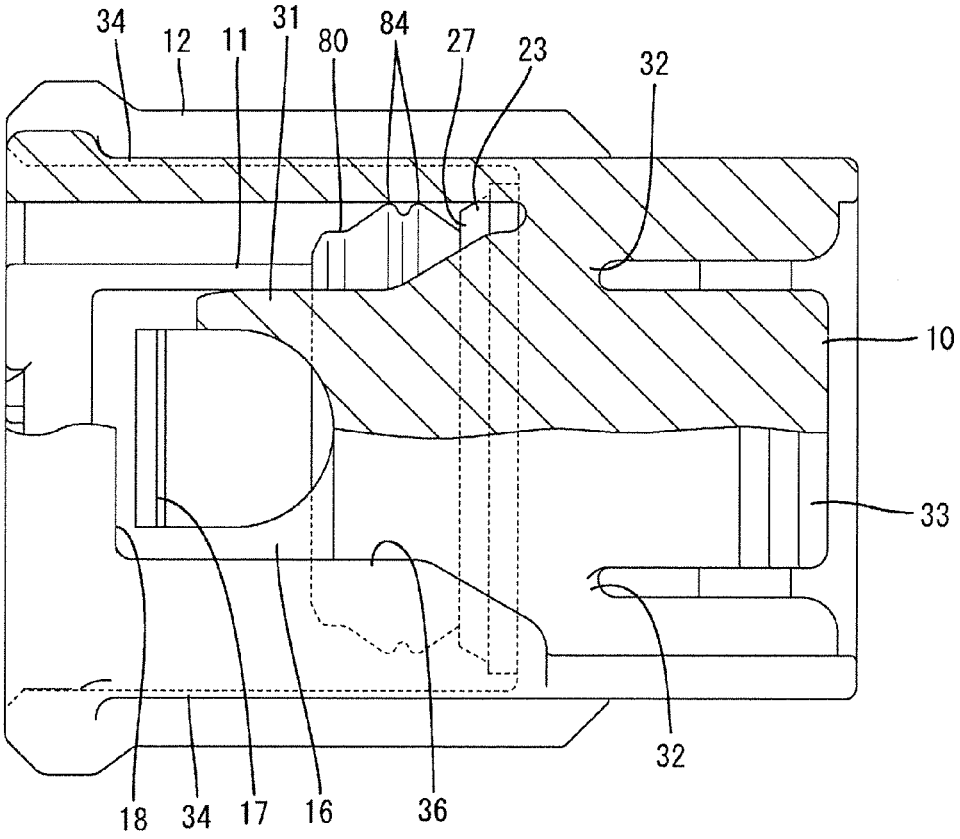
FIG. 6 is a plan view partly in section of the first housing in which the seal ring is mounted.
Figure 10:
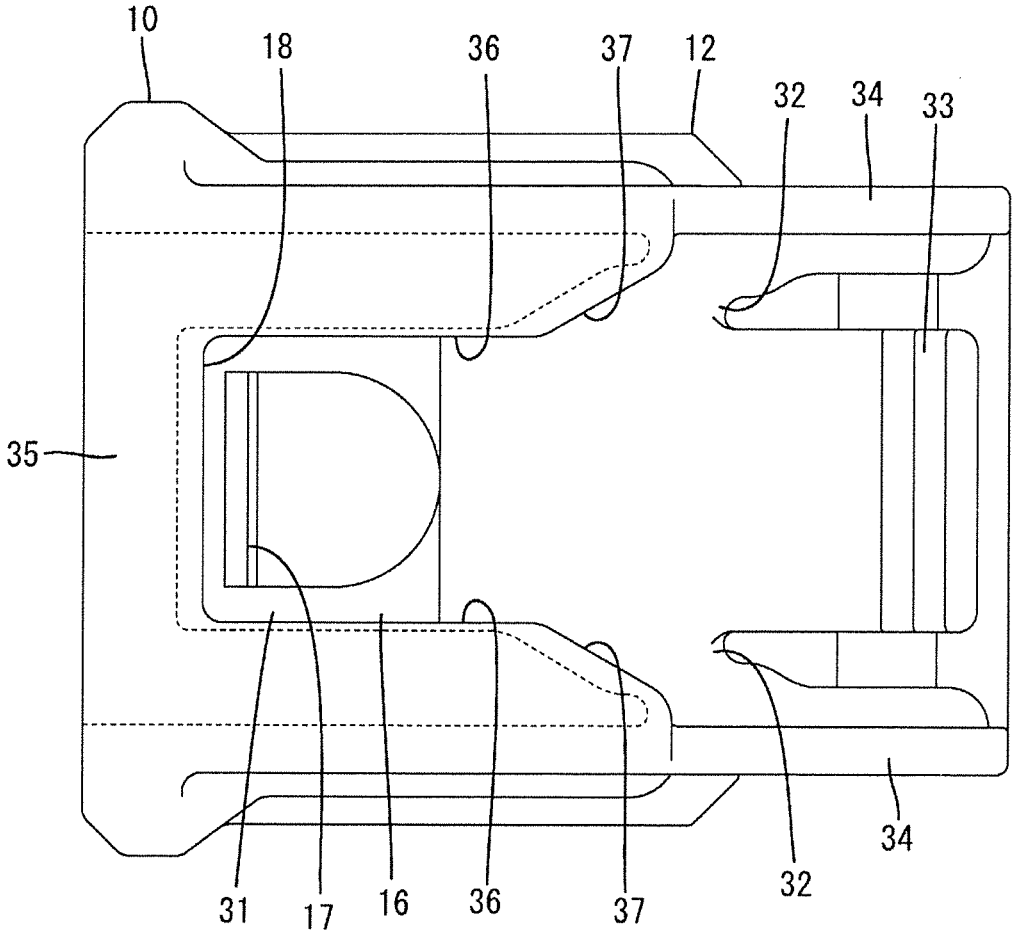
FIG. 10 is a plan view of the first housing.

As shown in FIGS. 6 and 10, the lock arm 16 includes a plate-like arm main body 31 extending in the front-back direction and a pair of deflection supporting portions 32 laterally protruding from opposite widthwise end parts at an intermediate position of the arm main body 31 in the front-back direction and integrally coupled to protection walls 34 to be described later. The arm main body 31 is deflectable and deformable in directions to vertically move opposite front and rear end parts thereof with the deflection supporting portions 32 as supporting points. A stepped unlocking portion 33 to be pressed in disconnecting the first and second housings 10, 60 is provided on a rear end part of the arm main body 31.

A lock hole 17 penetrates through a front end part of the lock arm 16. As shown in FIG. 2, the lock portion 63 is resiliently fitted into the lock hole 17 of the lock arm 16 when the first and second housings 10, 60 are properly connected, whereby the first and second housings 10, 60 are held in a connected state. Note that a window portion 18 through which the lock arm 16 can be visually confirmed is open on the upper wall of the outer side wall 12.

Further, as shown in FIGS. 8 and 10, a pair of protection walls 34 stand at opposite sides of the lock arm 16 on opposite widthwise end parts of the first housing 10. The both protection walls 34 are in the form of vertically extending vertical walls and formed substantially over the entire length of the housing main body 11 in the front-back direction. Rear parts of the both protection walls 34 are integrally coupled to the both deflection supporting portions 32 of the lock arm 16.

Further, the first housing 10 is provided with a covering wall 35 for covering the front end part of the lock arm 16 from above. The covering wall 35 is in the form of a flat plate extending in a width direction and bridged in the width direction between the both protection walls 34 by being integrally coupled to upper parts of the front ends of the both protection walls 34.

Furthermore, as shown in FIG. 10, the first housing 10 is provided with a pair of eaves portions 36 for covering parts of opposite widthwise end parts of the lock arm 16 from the front end part of the lock arm 16 to front end parts of the deflection supporting portions 32. Thus, clearances between the opposite widthwise end parts of the front part of the lock projection 16 and the both protection wall 34 are filled by the both eaves portions 36.

The both eaves portions 36 are in the form of flat plates connected and substantially flush with the covering wall 35 and integrally connected to the rear end of the covering wall 35 and the upper ends of the both protection walls 34 and protrude inwardly in the width direction from the both protection walls 34. As shown in FIG. 10, the both eaves portions 36 and the covering wall 35 are connected into a U shape in a plan view and the lock hole 17 is arranged in an exposed manner in the window portion 18 inside of the U shape. Further, a pair of oblique edge portions 37 inclined in directions to gradually approach each other toward a front side in a plan view are provided on the rear ends of the both eaves portions 36.

Figure 5:
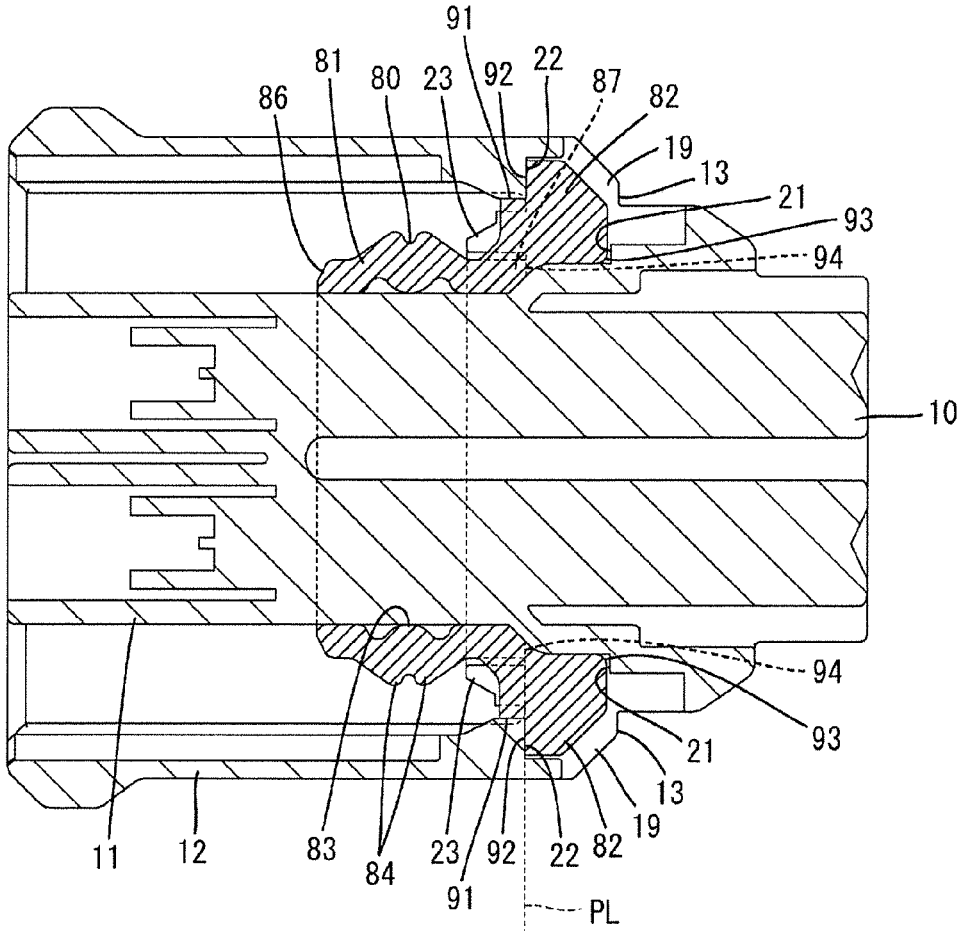
FIG. 5 is a section cut at a position corresponding to a retaining portion in the first housing in which the seal ring is mounted.

Further, as shown in FIG. 8, a pair of retaining holes 19 are formed on the opposite widthwise end parts of the first housing 10. As shown in FIG. 5, the both retaining holes 19 penetrate through the outer side wall 12 and the coupling portion 13 and each include a contact receiving surface 21 arranged to face forward and extend substantially in a radial direction on a rear part of the inner surface and a lock receiving surface 22 arranged to face backward and extend substantially in a radial direction on a front part of the inner surface.

Further, as shown in FIG. 9, a protrusion 23 is formed to project forwardly on the coupling portion 13 of the first housing 10. As shown in FIG. 8, the protrusion 23 is formed to extend in a wide range in a circumferential direction to surround the housing main body 11 in residual areas of the coupling portion 13 except areas corresponding to the retaining holes 19. A later-described rear ring portion 87 of the seal ring 80 is fittable into an inner space 24 (see FIG. 9) defined by the inner surface of the protrusion 23, the front surface of the coupling portion 13 and the outer surface of the housing main body 11. A tapering inclined surface 25 which can be held in close contact with a later-described guiding surface 88 of the rear ring portion 87 is formed on a part connecting the outer surface of the housing main body 11 and the front surface of the coupling portion 13.

Figure 3:
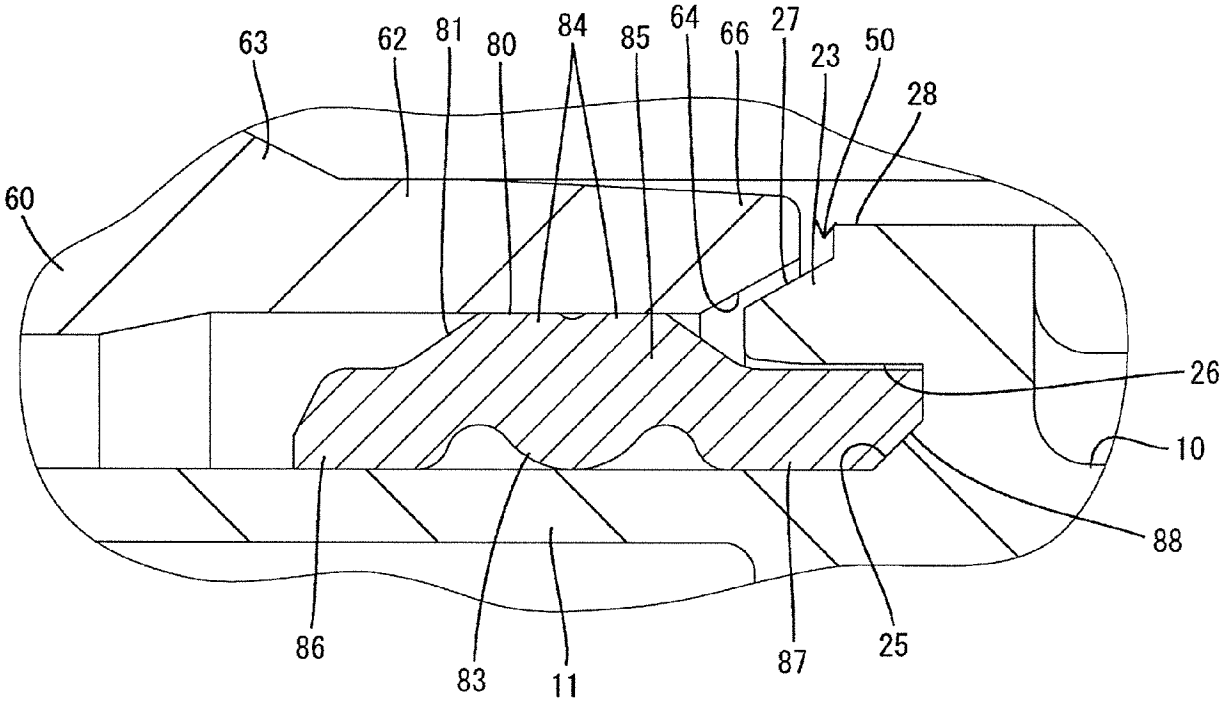
FIG. 3 is a partial enlarged view of FIG. 2.

As shown in FIG. 3, the inner surface of the protrusion 23 serves as a restricting surface 26 located to face the outer surface of the housing main body 11 substantially in parallel. The restricting surface 26 of the protrusion 23 can prevent the rear ring portion 87 from being flipped up by coming into contact with the ring portion 87 from an outer side.

The outer surface of the protrusion 23 has a tapering first inclined surface 27 located to face the inner surface of the outer side wall 12 and gradually narrowing the protrusion 23 toward the front side. When the receptacle 62 is externally fitted on the housing main body 11, the first inclined surface 27 of the protrusion 23 and the second inclined surface 64 of the receptacle 62 are arranged to face each other. Further, the outer surface of the protrusion 23 has a horizontal surface 28 extending substantially in the front-back direction toward the coupling portion 13 after being connected to the first inclined surface 27 while forming a step (see FIG. 3).

Figure 1:
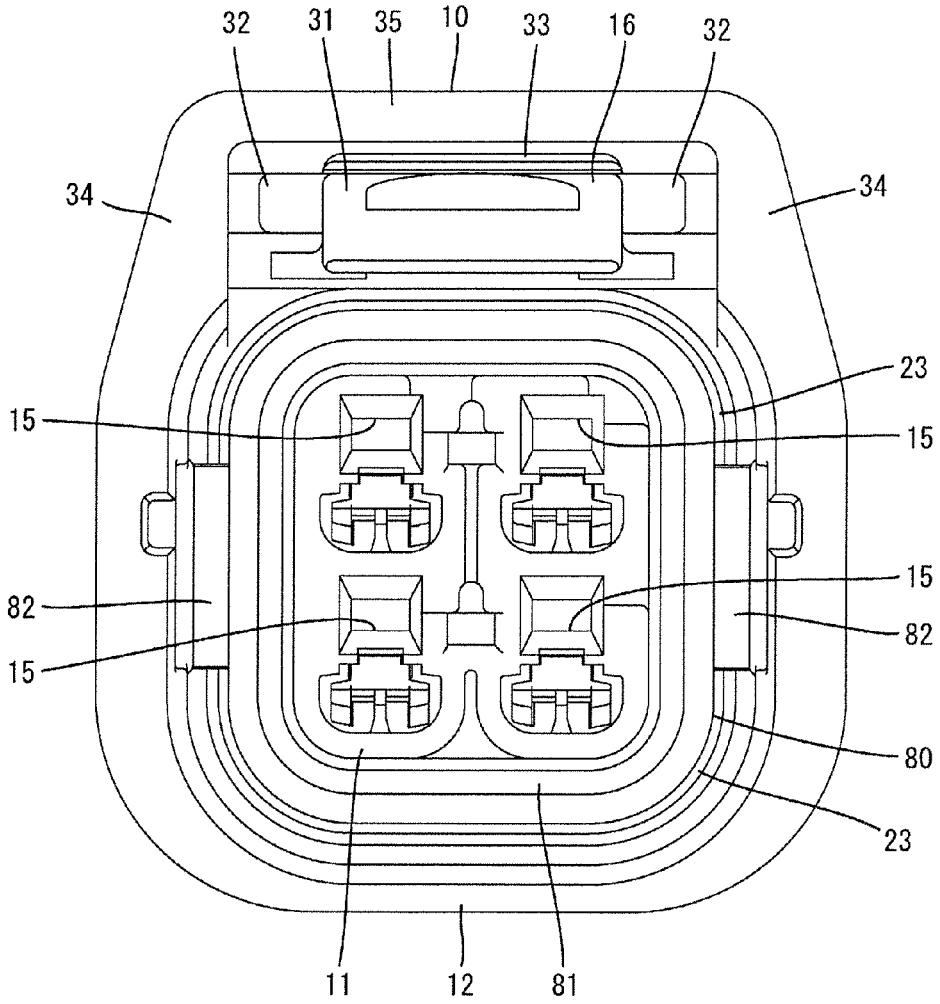
FIG. 1 is a front view of a first housing, in which a seal ring is mounted, according to a waterproof connector of the present invention.

The seal ring 80 is made of rubber such as silicon rubber and includes, as shown in FIGS. 1 and 5, an annular seal main body 81 facing the outer surface of the housing main body 11 and retaining portions 82 projecting radially outwardly after projecting backwardly from opposite widthwise end parts of the seal main body 81.

Figure 7:
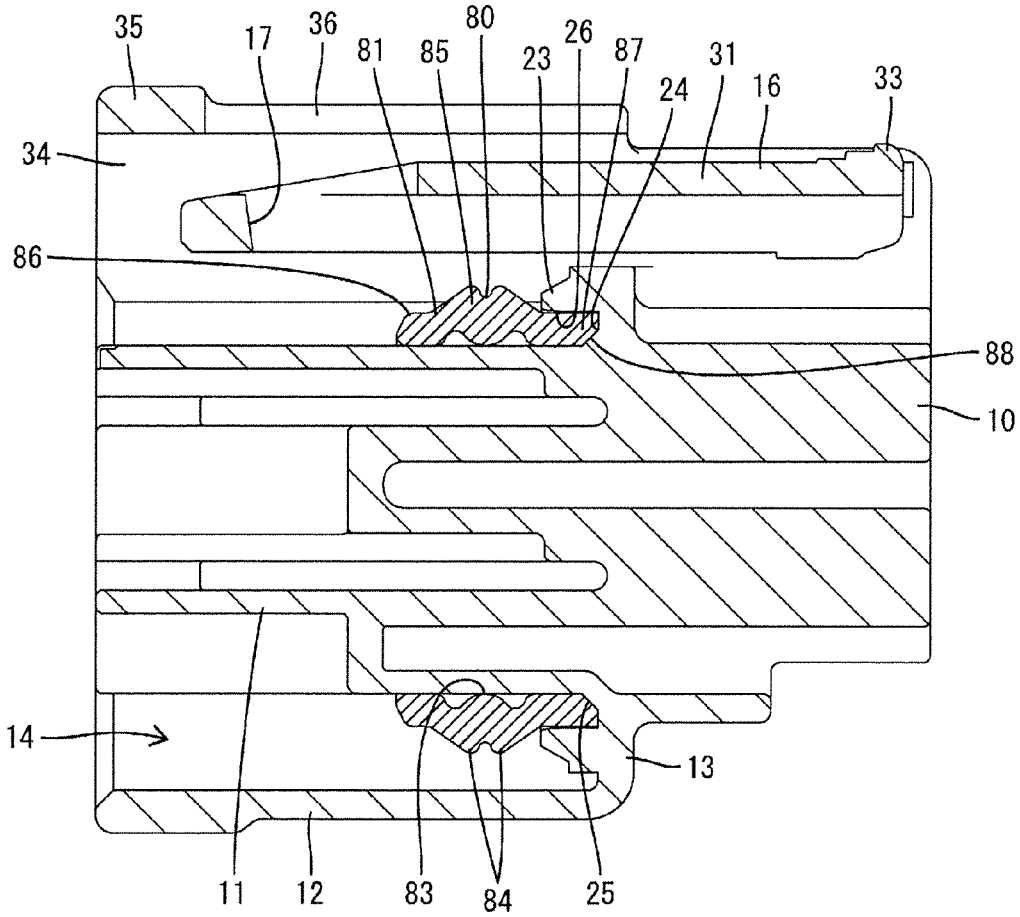
FIG. 7 is a section of the first housing in which the seal ring is mounted.

As shown in FIG. 7, a seal portion 85 with an inner peripheral lip 83 and outer peripheral lips 84 is formed at an intermediate position of the seal main body 81 in the front-back direction. The inner peripheral lip 83 is in the form of an elongated projection circumferentially provided on the inner surface of the seal portion 85 and arranged between front and rear troughs. The outer peripheral lip 84 is in the form of an elongated projection circumferentially provided on the outer surface of the seal portion 85 and two outer peripheral lips 84 are arranged side by side in the front-back direction. In this case, a trough between the outer peripheral lips 84 is arranged at the same position as the inner peripheral lip 83 in the front-back direction. As shown in FIG. 3, in a state where the first and second housings 10, 60 are properly connected, the inner peripheral lip 83 is resiliently held in close contact with the outer surface of the housing main body 11 and the both outer peripheral lips 84 are resiliently held in close contact with the inner surface of an opening edge side of the receptacle 62, thereby sealing between the first and second housings 10, 60 in a liquid-tight manner.

Further, the seal main body 81 includes front and rear ring portions 86, 87 extending substantially in the front-back direction on opposite end parts in the front-back direction at opposite front and rear sides of the seal portion 85. The respective front and rear ring portions 86, 87 are thinner than the seal portion 85, include no lip and are flatly held in close contact with the outer surface of the housing main body 11 and the inner surface of the receptacle 62. Out of the front and rear ring portions 86, 87, the rear ring portion 87 is longer in the front-back direction than the front ring portion 86. Further, as shown in FIG. 3, the inner periphery of the rear end of the rear ring portion 87 is cut to form the tapering guiding surface 88.

As shown in FIG. 5, the retaining portion 82 is thicker than the seal main body 81, a radially outer side of a front end portion of the retaining portion 82 is cut to form a recess 91 having a substantially L-shaped cross-section, this recess 91 has a locking surface 92 arranged to face forward and extending substantially in the width direction and a contact surface 93 arranged to face backward and extend substantially in a radial direction is provided on a radially inner side of a rear end part of the retaining portion 82. The locking surface 92 is arranged at the same position as a rear end surface 94 of the rear ring portion 87 in the front-back direction and a position in the front-back direction specified by this locking surface 92 and the rear end surface 94 of the rear ring portion 87 serves as a parting line PL of a mold in molding.

Next, functions of the waterproof connector of this embodiment are described.

In assembling, the seal ring 80 is mounted on the outer surface of the housing main body 11 from front. When the seal ring 80 is properly mounted as shown in FIG. 5, the both retaining portions 82 are resiliently fitted into the corresponding retaining holes 19, the contact surfaces 93 of the both retaining portions 82 come into contact with the contact receiving surfaces 21 of the both retaining holes 19 to prevent the seal ring 80 from being pressed any further and the locking surfaces 92 of the both retaining portions 82 come into contact with the lock receiving surfaces 22 of the both retaining holes 19 to prevent forward detachment of the seal ring 80.

Further, radially outer ends of the both retaining portions 82 are resiliently held in close contact with the inner surface of the outer side wall 12 and radially inner ends of the both retaining portions 82 are resiliently held in close contact with the outer surface of the housing main body 11, whereby the retaining portions 82 are radially sandwiched between the outer side wall 12 and the housing main body 11. In this way, the retaining portions 82 are positioned and fixed in the retaining holes 19 and the seal ring 80 is held in a proper state.

Further, when the seal ring 80 is properly mounted on the housing main body 11, the rear ring portion 87 is fitted and inserted into the inner space 24 between the protrusion 23 and the housing main body 11 as shown in FIG. 7 and the outer surface of the rear ring portion 87 is located to face the restricting surface 26 of the protrusion 23 while forming a very small clearance (see FIG. 3). In this way, the rear ring portion 87 is positioned and held between the protrusion 23 and the housing main body 11.

Subsequently, the first and second housings 10, 60 are so connected to each other that the receptacle 62 is externally fitted on the housing main body 11. In the process of connecting the first and second housings 10, 60, the second inclined surface 64 of the receptacle 62 slides in contact with the outer peripheral lips 84 and a backward shear force acts on the seal ring 80 as the receptacle 62 is pushed. In this case, the rear ring portion 87 may be flipped up along the front surface of the coupling portion 13, but a situation where the rear ring portion 87 is flipped or buckled is avoided by the contact of the rear ring portion 87 with the restricting surface 26 of the protrusion 23 according to this embodiment.

Figure 4:
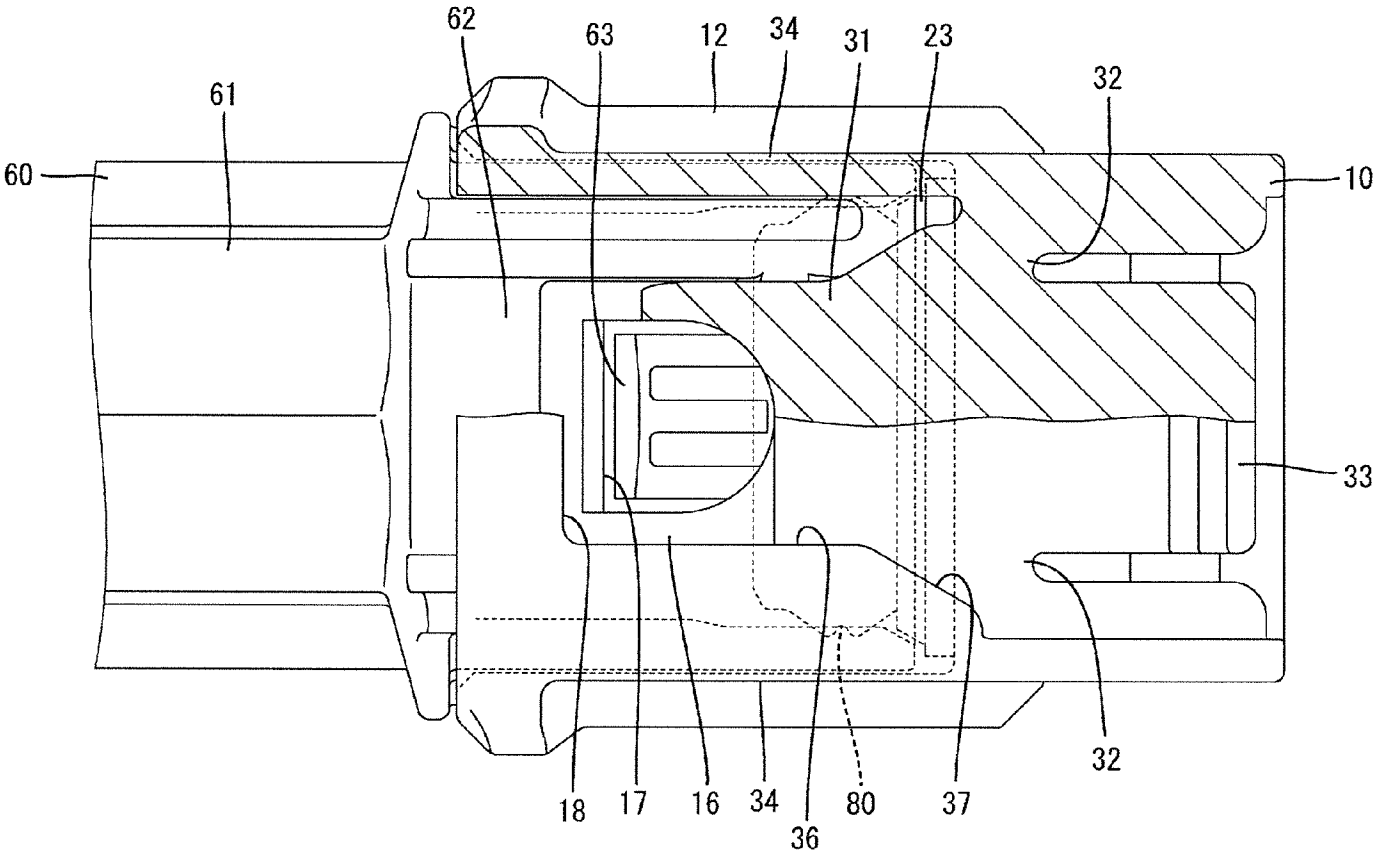
FIG. 4 is a plan view partly in section showing the state where the first and second housings are properly connected.

When the first and second housings 10, 60 are properly connected as shown in FIG. 4, the lock portion 63 is resiliently fitted into the lock hole 17 of the lock arm 16 and that state can be visually confirmed through the window portion 18.

Further, when the first and second housings 10, 60 are properly connected as shown in FIG. 3, the both outer peripheral lips 84 of the seal ring 80 are resiliently held in close contact with the inner surface of the opening end side of the receptacle 62, the opening edge portion 66 of the receptacle 62 is located to cover the protrusion 23 from an outer side and the second inclined surface 64 of the receptacle 62 is located to proximately face the first inclined surface 27 of the protrusion 23.

As shown in FIG. 3, by covering the protrusion 23 with the opening edge portion 66 of the receptacle 62, even if a clearance 50 is formed in the front-back direction between the opening end of the receptacle 62 and the front surface of the coupling portion 13, the protrusion 23 is located at an inner back side of the clearance 50 and the rear ring portion 87 is not exposed to a radially outer side. Thus, even if washing water enters the clearance 5, for example, during high-pressure washing, the first inclined surface 27 of the protrusion 23 is wetted, wherefore the rear ring portion 87 is not directly wetted. As a result, a high water pressure does not act on the rear ring portion 87, wherefore a situation where the rear ring portion 87 is deformed by a water pressure is prevented.

Further, the clearances between the lock arm 16 and the both protection walls 34 are filled up by the both eaves portions 36, whereby the seal ring 80 is concealed by the arm main body 31 of the lock arm 16 and the both eaves portions 36 when viewed from above. Thus, high-pressure washing water does not directly splash on the seal ring 80. Therefore, a situation where the seal ring 80 is deformed is more reliably prevented.

In addition, since the peripheral edge of a front part of the lock arm 16 is covered by the covering wall 35 and the both eaves portions 36, even if the wire 4 bent in a U shape is, for example, about to come to the front side of the lock arm 16, the wire 4 comes into contact with the both eaves portions 36, whereby the wire 4 is not caught by the front end part of the lock arm 16 and a situation where the lock arm 16 is flipped is avoided. Particularly, since the rear ends of the both eaves portions 36 are configured to escape by the both oblique edge portions 37, it can be also avoided that the wire 4 is caught by the both eaves portions 36.

As described above, according to this embodiment, a situation where the rear ring portion 87 is flipped or buckled as the receptacle 62 is moved is avoided since the rear ring portion 87 is radially sandwiched between the protrusion 23 of the first housing 10 and the housing main body 11. Further, since the protrusion 23 is covered with the opening edge portion 66 of the receptacle 62 when the receptacle 62 is externally fitted on the housing main body 11, the rear ring portion 87 is not directly wetted during high-pressure washing and the deformation of the rear ring portion 87 by high-pressure water is prevented. Thus, according to this embodiment, sealing performance of the seal ring 80 is satisfactorily exhibited. Above all, since the parting line PL of the mold is specified by the locking surfaces 92 of the retaining portions 82 and the rear end surface 94 of the rear ring portion 87 in the case of this embodiment, the rear ring portion 87 tends to be longer in the front-back direction than the front ring portion 86. Thus, a merit of avoiding the flipping and buckling of the rear ring portion 87 by the protrusion 23 is large.

Further, according to this embodiment, even if the covering wall 35 is thinned due to a demand to reduce the height of the connector, the covering wall 35 is reinforced by the eaves portions 36 and can maintain predetermined strength since the pair of eaves portions 36 are integrally coupled to the covering wall 35 and the both protection walls 34. In addition, since the both eaves portions 36 extend from the front end part of the lock arm 16 to the deflection supporting portions 32 and cover the opposite widthwise end parts of the lock arm 16, a situation where the lock arm 16 is flipped up by being caught by the wire 4 or the like is avoided. Thus, even if the both eaves portions 36 are provided, the configuration of the connector does not become uselessly complicated.

Further, since the both eaves portions 36 are arranged to entirely cover ranges of the opposite widthwise end parts of the lock arm 16 from the front end part of the lock arm 16 to the deflection supporting portions 32 of the lock arm 16, the lock arm 16 is more reliably protected.

In addition, since the both eaves portions 36 are arranged at such positions as not to cover the lock hole 17, a state where the lock portion 63 is fitted in the lock hole 17 can be visually confirmed when the first and second housings 10, 60 are connected, and it can be detected that the first and second housings 10, 60 are in the connected state.

Furthermore, since the seal ring 80 is concealed by the lock arm 16 and the both eaves portions 36 when viewed from above, the wetting of the seal ring 80 is avoided and the deformation of the seal ring 80 by high-pressure water is prevented, for example, during high-pressure washing. As a result, predetermined sealability by the seal ring 80 is maintained.

Note that the following technical concept can be extracted from this embodiment.

The connector includes the first housing 10 connectable to the second housing 60, the lock arm 16 for holding the first and second housings 10, 60 in the connected state by resiliently locking the lock portion 63 of the second housing 60 during connection to the second housing 60 is deflectably provided on the first housing 10, the pair of protection walls 34 stand at the opposite sides of the lock arm 16, the covering wall 35 is provided to cover a tip part of the lock arm 16 and the pair of eaves portions 36 integrally coupled to the covering wall 35 and the both protection walls 34 and configured to cover the opposite widthwise end parts of the lock arm 16 by extending from the tip part of the lock arm 16 to the deflection supporting portions 32 are provided to project on the first housing 10.

Even if the covering wall 35 is thinned in response to a demand to reduce the height of the connector, the pair of eaves portions 36 are integrally coupled to the covering wall 35 and the both protection walls 34. Thus, the covering wall 35 is reinforced by the eaves portions 36 and predetermined strength can be maintained. Further, since the both eaves portions 36 extend from the tip part of the lock arm 16 to the deflection supporting portions 32 and cover the opposite widthwise end parts of the lock arm 16, a situation where the lock arm 16 is flipped up by being caught by the wire 4, 6 or the like is avoided. Since the both eaves portions 36 are provided not only merely to reinforce the covering wall 35, but also to provide a function of preventing the flipping of the lock arm 16, the configuration of the connector does not become uselessly complicated.

Further, the covering wall 35 is bridged in the width direction between the both protection walls 34 and integrally coupled to the both protection walls 34. This causes the covering wall 35 to be more strongly reinforced.

Further, any of the covering wall 35 and the both eaves portions 36 is in the form of a flat plate extending in the width direction. This can suppress an increase in the height of the connector.

Further, the both eaves portions 36 are arranged to entirely cover the ranges of the opposite widthwise end parts of the lock arm 16 from the tip part of the lock arm 16 to the deflection supporting portions 32 of the lock arm 16. By covering the opposite widthwise end parts of the lock arm 16 over wide ranges by the both eaves portions 36, the lock arm 16 is more reliably protected.

Further, the lock hole 17 into which the lock portion 63 of the second housing 60 is to be fitted penetrates through the lock arm 16, and the both eaves portions 36 are arranged at such positions as not to cover the lock hole 17. This enables visual confirmation of the state where the lock portion 63 of the second housing 60 is fitted in the lock hole 17 when the first and second housings 10, 60 are connected, and it can be detected that the first and second housings 10, 60 are in the connected state.

Further, the both eaves portions 36 protrude inwardly in the width direction from the both protection walls 34 and projecting ends of the both eaves portions 36 serve as the oblique edge portions 37 inclined in the directions to approach each other toward the covering wall 35 in a plan view. According to this, it can be avoided that the eaves portions 36 are caught by the looped wire 4, 6 and handling of the wires 4, 6 can be improved.

Further, the first housing 10 includes the housing main body 11 on which the receptacle 62 of the second housing 60 is externally fittable, and the seal ring 80 for sealing between the first and second housings 10, 60 in a liquid-tight manner by being resiliently sandwiched between the housing main body 11 and the receptacle 62 during connection to the second housing 60 is provided in the housing main body 11 and is concealed by the lock arm 16 and the both eaves portions 36 on a side where the lock arm 16 is located. Since the seal ring 80 is concealed by the both eaves portions 36 in addition to by the lock arm 16, the wetting of the seal ring 80 is avoided and the deformation of the seal ring 80 by high-pressure water is prevented, for example, during high-pressure washing.

Here, background information having led to the above configuration is described. For example, a connector disclosed in Japanese Unexamined Patent Publication No. 2005-216614 includes a female housing connectable to a mating male housing. A cantilever-shaped lock arm is deflectably provided in the female housing. When the both male and female housings are properly connected, the lock arm resiliently locks a lock portion of the male housing and the two housings are held in a connected state. Further, a pair of protection walls (called "standing walls" in the above literature) stand at opposite sides of the lock arm on the female housing, and a covering wall (called "protection wall" in the above literature) for covering a tip part of the lock arm by being integrally coupled to the both protection walls is provided. By providing the female housing with the covering wall and the both protection walls, the tip part of the lock arm is kept protected from external matters also when the female housing stands alone.

In the case of the above conventional connector, since the covering wall has to be provided at such a height position as to be able to cover the tip part of the lock arm, the height of the connector is increased as a whole. If it is attempted to reduce the height by thinning the covering wall in view of this, the covering wall becomes weak and may be deformed during interference with an external matter. Thus, the covering wall needs to be reinforced, but there is a problem that the configuration of the connector becomes uselessly complicated only by reinforcing the covering wall, which is not preferable. Taking this into consideration, the above configuration has been achieved.

The present invention is not limited to the above described and illustrated embodiment. For example, the following modes are also included in the technical scope of the present invention.

The outer surface of the rear ring portion may come into contact with the restricting surface of the protrusion when the seal ring is properly mounted on the housing.

The inner surface of the seal portion of the seal ring may be formed flat by omitting the inner peripheral lip from the seal portion.

At least one of the first inclined surface and the second inclined surface may be omitted to form a straight surface extending in the front-back direction.

The second housing may be a housing for board to be mounted on a printed circuit board and male terminal fittings may be in the form of pins connectable to the board by soldering.

The retaining portions may be omitted from the seal ring. In that case, the seal ring may be retained by a peripheral wall of a front member mounted into the housing main body from front.

The both eaves portions may be formed to cover ranges of the opposite widthwise end parts of the lock arm from the front end part of the lock arm to the front ends of the deflection supporting portion.

The both eaves portions may be formed to cover ranges of the opposite widthwise end parts of the lock arm from the front end part of the lock arm to positions beyond the rear ends of the deflection supporting portions.

LIST OF REFERENCE SIGNS

10 . . . first housing
11 . . . housing main body
12 . . . outer side wall
13 . . . coupling portion (resting portion)
16 . . . lock arm
17 . . . lock hole
22 . . . lock receiving surface
23 . . . protrusion
31 . . . arm main body
32 . . . deflection supporting portion
34 . . . protection wall
35 . . . covering wall
36 . . . eaves portion
60 . . . second housing
62 . . . receptacle
63 . . . lock portion
66 . . . opening edge portion

80 . . . seal ring
81 . . . seal main body
82 . . . retaining portion
84 . . . outer peripheral lip (lip)
85 . . . seal portion
86 . . . front ring portion
87 . . . rear ring portion
92 . . . locking surface
PL . . . parting line

The invention claimed is:

1. A waterproof connector, comprising:

a second housing including a tubular receptacle;

a first housing including a housing main body on which the receptacle is to be fit externally from front and a radially extending resting portion formed on an outer surface of the housing main body; and a seal ring fit on the outer surface of the housing main body, the seal ring having a rear end rested on the resting portion and including a lip circumferentially provided at an intermediate position in a front-back direction and to be held resiliently in contact with an inner surface of the receptacle when the receptacle is fit externally on the housing main body;

wherein:

the seal ring includes a front ring portion and a rear ring portion extending substantially in the front-back direction at opposite front and rear sides of the lip;

the rear ring portion is sandwiched radially between the first housing and the housing main body and the first housing includes a protrusion to be covered with an opening edge portion of the receptacle when the receptacle is fit externally on the housing main body; and a first inclined surface is provided on an outer surface of the protrusion and is inclined in a direction to approach the housing main body toward a front side, and a second inclined surface is provided on an inner surface of the opening edge portion of the receptacle, the second inclined surface is arranged to face the first inclined surface when the receptacle is fit externally on the housing main body.

2. The waterproof connector of claim 1, wherein the rear ring portion is longer in the front-back direction than the front ring portion.

3. The waterproof connector of claim 1, wherein an inner surface of the protrusion defines a restricting surface arranged at a position facing the outer surface of the housing main body and configured for preventing the rear ring portion from being flipped up by coming into contact with the rear ring portion from an outer side.

4. The waterproof connector of claim 1, wherein the first housing includes an outer side wall surrounding the housing main body and a radially extending coupling portion coupling the outer side wall and the housing main body, a fitting space into which the receptacle is to be fit is open between the housing main body and the outer side wall and before the coupling portion, and the protrusion projects on a front surface of the coupling portion.

5. A waterproof connector, comprising:

a second housing including a tubular receptacle;

a first housing including a housing main body on which the receptacle is to be fit externally from front and a radially extending resting portion formed on an outer surface of the housing main body; and a seal ring fit on the outer surface of the housing main body, the seal ring having a rear end rested on the resting portion and including a lip circumferentially provided at an intermediate position in a front-back direction and to be held resiliently in contact with an inner surface of the receptacle when the receptacle is fit externally on the housing main body;

wherein:

the seal ring includes a front ring portion and a rear ring portion extending substantially in the front-back direction at opposite front and rear sides of the lip;

the rear ring portion is sandwiched radially between the first housing and the housing main body and the first housing includes a protrusion to be covered with an opening edge portion of the receptacle when the receptacle is fit externally on the housing main body; and a retaining portion projects radially on the seal ring for preventing forward detachment of the seal ring by being locked to the first housing, the protrusion is not formed at a position facing the retaining portion when the seal ring is fit on the outer surface of the housing main body, an outer side wall of the first housing is arranged at an outer side of the retaining portion, and the retaining portion is sandwiched radially between the outer side wall and the housing main body.

6. The waterproof connector of claim 5, wherein a first inclined surface is provided on an outer surface of the protrusion and is inclined in a direction to approach the housing main body toward a front side, and a second inclined surface is provided on an inner surface of the opening edge portion of the receptacle, the second inclined surface is arranged to face the first inclined surface when the receptacle is fit externally on the housing main body.

7. The waterproof connector of claim 5, wherein the protrusion surrounds the housing main body except at a part for locking the retaining portion.

8. The waterproof connector of claim 5, wherein the rear ring portion is longer in the front-back direction than the front ring portion.

9. The waterproof connector of claim 5, wherein an inner surface of the protrusion defines a restricting surface arranged at a position facing the outer surface of the housing main body and configured for preventing the rear ring portion from being flipped up by coming into contact with the rear ring portion from an outer side.

10. The waterproof connector of claim 5, wherein the first housing includes an outer side wall surrounding the housing main body and a radially extending coupling portion coupling the outer side wall and the housing main body, a fitting space into which the receptacle is to be fit is open between the housing main body and the outer side wall and before the coupling portion, and the protrusion projects on a front surface of the coupling portion.

11. A waterproof connector, comprising:

a second housing including a tubular receptacle;

a first housing including a housing main body on which the receptacle is to be fit externally from front and a radially extending resting portion formed on an outer surface of the housing main body; and a seal ring fit on the outer surface of the housing main body, the seal ring having a rear end rested on the resting portion and including a lip circumferentially provided at an intermediate position in a front-back direction and to be held resiliently in contact with an inner surface of the receptacle when the receptacle is fit externally on the housing main body;

wherein:

the seal ring includes a front ring portion and a rear ring portion extending substantially in the front-back direction at opposite front and rear sides of the lip;

the rear ring portion is sandwiched radially between the first housing and the housing main body and the first housing includes a protrusion to be covered with an opening edge portion of the receptacle when the receptacle is fit externally on the housing main body; and a retaining portion projects radially on the seal ring for preventing forward detachment of the seal ring by being locked to the first housing, the retaining portion has a locking surface facing a lock receiving surface of the first housing in the front-back direction, the locking surface is arranged at the same position as a rear surface of the rear ring portion in the front-back direction, and a parting line of a mold is formed by the rear surface of the rear ring portion and the lock receiving surface.

12. The waterproof connector of claim 11, wherein the rear ring portion is longer in the front-back direction than the front ring portion.

13. The waterproof connector of claim 11, wherein an inner surface of the protrusion defines a restricting surface arranged at a position facing the outer surface of the housing main body and configured for preventing the rear ring portion from being flipped up by coming into contact with the rear ring portion from an outer side.

14. The waterproof connector of claim 11, wherein the first housing includes an outer side wall surrounding the housing main body and a radially extending coupling portion coupling the outer side wall and the housing main body, a fitting space into which the receptacle is to be fit is open between the housing main body and the outer side wall and before the coupling portion, and the protrusion projects on a front surface of the coupling portion.

15. The waterproof connector of claim 11, wherein a first inclined surface is provided on an outer surface of the protrusion and is inclined in a direction to approach the housing main body toward a front side, and a second inclined surface is provided on an inner surface of the opening edge portion of the receptacle, the second inclined surface is arranged to face the first inclined surface when the receptacle is fit externally on the housing main body.

* * * * *